US006105409A

United States Patent [19]

Kojima et al.

[11] Patent Number: 6,105,409

[45] Date of Patent: Aug. 22, 2000

[54] METHOD AND APPARATUS FOR HYDROFORMING METALLIC TUBE

[75] Inventors: Masayasu Kojima, Takarazuka; Saburo Inoue, Tama, both of Japan

[73] Assignee: Sumitomo Metal Industries, Ltd., Hyogo, Japan

[21] Appl. No.: 09/119,963

[22] Filed: Jul. 21, 1998

[30] Foreign Application Priority Data

Aug. 6, 1997 [JP] Japan ..... 9-211679

[51] Int. Cl.[7] ..... B21D 39/08; B21D 26/02

[52] U.S. Cl. ..... 72/58; 72/61; 29/421.1

[58] Field of Search ..... 72/58, 61, 62, 72/59, 57; 29/421.1

[56] References Cited

U.S. PATENT DOCUMENTS

| | | | |
|---|---|---|---|
| 5,561,902 | 10/1996 | Jacobs et al. | 72/61 |
| 5,802,899 | 9/1998 | Klaas et al. | 72/58 |
| 5,890,387 | 4/1999 | Roper et al. | 72/58 |

FOREIGN PATENT DOCUMENTS

| | | | |
|---|---|---|---|
| 39-22138 | 10/1964 | Japan | 72/62 |
| 45-1344 | 1/1970 | Japan | 72/57 |
| 55-77934 | 6/1980 | Japan | 72/57 |
| 56-154228 | 11/1981 | Japan . | |
| 61-235025 | 10/1986 | Japan . | |
| 385146 | 3/1965 | Switzerland | 72/57 |
| 593768 | 2/1978 | U.S.S.R. | 72/57 |

OTHER PUBLICATIONS

E.I. Isachenkov, D.Sc., "Molding by Rubber and Liquid", 2nd Revised and Supplemented Edition Mashinostroenie, pp. 317–321, 1967.

*Primary Examiner*—David Jones
*Attorney, Agent, or Firm*—Lane, Aitken & McCann

[57] ABSTRACT

A method for hydroforming a metallic tube comprising primary hydroforming and secondary hydroforming, wherein in the primary hydroforming step, the metallic tube is formed such that a circumferential length of an expanded portion of the primary-hydroformed tube as measured at a wall center region of the expanded portion becomes substantially equal to or slightly shorter than a circumferential length of an expanded portion of a product as measured at a wall center region of the expanded portion, and in the secondary hydroforming step, movable pads incorporated in the dies press the expanded portion formed through primary hydroforming so as to finish the cross-sectional profile of the expanded portion into that of the expanded portion of the product, and said primary hydroforming and secondary hydroforming are continuously performed within the dies. Also disclosed is an apparatus for performing the hydroformation method. According to the method of the present invention, high liquid pressure is not required, and reduction in wall thickness and shape defects can be revented.

1 Claim, 14 Drawing Sheets

Fig.5((b)

METHOD AND APPARATUS FOR HYDROFORMING METALLIC TUBE

This application claims priority under 35 U.S.C.119 and/or 365 to Japan Patent application No.9-211679 filed in Japan on Aug. 6,1997, the entire content of which is herein incorporated by reference.

BACKGROUND OF THE INVENTION

1. Field of the Invention

The present invention relates to a method and an apparatus for hydroforming a metallic tube.

2. Description of the Related Art

Metallic tube hydroforming comprises the steps of introducing a hydraulic fluid into a metallic tube serving as a material tube (hereinafter, referred to merely as a metallic tube) and applying an axial force to the tube ends, to thereby form the metallic tube through combined use of hydraulic pressure and the axial force. The hydroforming process provides tubular parts having a variety of cross-sectional profiles.

FIGS. 7(*a*1), 7(*a*2), 7(*b*1), 7(*b*2), 7(*c*1), and 7(*c*2) show a metallic tube and products. FIG. 7(*a*1) is a side view showing a metallic tube, and FIG. 7(*a*2) is a front view showing the metallic tube. FIGS. 7(*b*1) and 7(*c*1) are side views of products obtained through tube hydroforming, and FIGS. 7(*b*2) and 7(*c*2) are front views of the products.

Each of the products includes an expanded portion 2*a* (3*a*) having a rectangular cross section and end portions 2*b*

FIGS. 7(*c*1) and 7(*c*2) show a product 3 in which at least one (in this case, $D_1$) of side lengths $D_1$ and $D_2$ of the expanded portion 3*a* is smaller than the tube diameter $D_0$. Overall lengths $L_1$ and $L_2$ of the products 2 and 3, respectively, are shorter than the length $L_0$ of tube 1

First will be described a conventional hydroforming apparatus used for obtaining the product 2.

FIGS. 8(*a*) and 8(*b*) show a die portion of the conventional hydroforming apparatus. FIG. 8(*a*) is a longitudinal sectional view showing the die portion. FIG. 8(*b*) is a sectional view taken along the line 8(*b*)—8(*b*) of FIG. 8(*a*).

The die is composed of a lower die 4 and an upper die 5. The lower die 4 is attached to a bolster 10 of an unillustrated press unit. The bolster 10 is located at a lower portion of the press unit. The upper die 5 is attached to a ram head 11 of the press unit. The ram head 11 is located at an upper portion of the press unit. The ram head 11 is moved vertically by means of an unillustrated hydraulic cylinder so as to press the upper die 5 against the lower die 4 with a predetermined force. Die cavities 4*a*, 5*a* and a tube-holding groove 4*b*,5*b* for containing a metallic tube therein are formed in the upper and lower die 4,5. When the upper and lower dies 5 and 4 are closed each other, a space defined ba the die cavities 4*a* and 5*a* is used for forming the expanded portion 2*a* of a product. The contour of the die cavities is identical to the external contour of the expanded portion 2*a* of a product. When the upper and lower dies 5 and 4 are closed each other, a space defined by the die cavities 4*a* and 5*a* is used for forming the expanded portion 2*a* of a product. The contour of the die cavities is identical to the external contour of the expanded portion 2*a* of a product. When the upper and lower dies 5 and 4 are closed each other,the diameter of the space defined by the tube-holding grooves 4*b* and 5*b* is identical to the outer diameter $D_0$ of the metallic tube 1. Left- and right-hand sealing-punch 6 and 7 are attached to unillustrated corresponding horizontal press units. The left- and right-hand sealing-punch 6 and 7 advance toward or retreat from the left- and right-hand tube-holding grooves 4*b* and 5*b*, respectively.

Next will be described a hydroforming process for obtaining the product 2 through use of the above-mentioned conventional hydroforming apparatus.

FIGS. 9(*a*1), 9(*a*2), 9(*b*1), 9(*b*2), 9(*c*), and 9(*d*) illustrate a conventional hydroforming process. FIG. 9(*a*1) is a longitudinal sectional view showing a metallic tube set in the upper and lower dies. FIG. 9(*a*2) is a sectional view taken along the line 9(*a*2)—9(*a*2) of FIG. 9(*a*1). FIG. 9(*b*1) is a longitudinal sectional view showing a final state of hydroforming. FIG. 9(*b*2) is a sectional view taken along the line 9(*b*2)—9(*b*2) of FIG. 9(*b*1). FIG. 9(*c*) is an enlarged view showing the encircled portion a of FIG. 9(*b*2). FIG. 9(*d*) is a perspective view showing a product ruptured during hydroforming.

As shown in FIGS. 9(*a*1) and 9(*a*2), first, the metallic tube 1 is set in the tube-holding grooves 4*b* formed in both end portions of the lower die 4. The ram head 11 is lowered so as to press the upper die 5 against the lower die 4. The sealing punches 6 and 7 are advanced from their respective sides so that head portions 6*a* and 7*a* of the sealing punches 6 and 7, respectively, are tightly inserted into both end portions of the metallic tube 1, thereby the tube ends are sealed during hydroforming. Next, while a hydraulic fluid 8 is introduced into the metallic tube 1 by means of an unillustrated pump through a path 6*b* extending through the left-hand sealing punch 6, air inside the metallic tube 1 is ejected through a path 7*b* extending through the right-hand sealing punch 7. An unillustrated valve located on the extension of the path 7*b* is closed after the interior of the metallic tube 1 is filled with the hydraulic fluid 8.

An example of the hydraulic fluid 8 is an emulsion prepared by dispersing a fat-and-oil component in water in an amount of several percent so as to produce a rust-preventive effect. The pressure of the hydraulic fluid 8 contained in the metallic tube 1 is increased advancing the sealing-punch 6 and 7 to press the metallic tube axially. Thus, the material of the metallic tube 1 is expanded within the die cavities 4*a* and 5*a* to form the product 2 as shown in FIGS. 9(*b*1) and 9(*b*2).

The upper and lower dies 5 and 4 are pressed against each other during the hydroforming in order to prevent the upper die 5 from being pressed upward off the lower die 4 when the metallic tube 1 is expanded through the application of fluid pressure and axial force. Axial pressing is performed in order to feed the material of the metallic tube 1 located in the tube-holding grooves 4*b* and 5*b* into the die cavities 4*a* and 5*a*, to thereby minimize the wall thinning of an expanded portion of the product 2.

Subsequently, the internal fluid pressure of the product 2 is reduced to atmospheric pressure. Then, the upper die 5 is moved upward, and the sealing punches 6 and 7 are retreated, thereby draining the hydraulic fluid 8 from inside the product 2. The product 2 is ejected from the lower die 4.

Next will be described a conventional hydroforming process for obtaining the product 3. FIGS. 10(*a*1), 10(*a*2), 10(*b*1), and 10(*b*2) illustrate conventional dies used for obtaining the product 3 through hydroforming. FIG. 10(*a*1) is a longitudinal sectional view of a set of lower die 14 and upper die 15. FIG. 10(*a*2) is a sectional view taken along the line 10(*a*2)—10(*a*2) of FIG. 10(*a*1). FIG. 10(*b*1) is a longitudinal sectional view of an another set of lower die 24 and upper die 25. FIG. 10(*b*2) is a sectional view taken along the line 10(*b*2)—10(*b*2) of FIG. 10(*b*1).

In FIGS. 10(*a*1) and 10(*a*2), the rectangular cross section of a space defined by die cavities 14*a* and 15*a* of a lower die 14 and an upper die 15, respectively, is profiled such that a vertical side length $D_1$ is shorter than a horizontal side length $D_2$. In FIGS. 10(*b*1) and 10(*b*2), the rectangular cross section of a space defined by die cavities 24*a* and 25*a* of a lower die 24 and an upper die 25, respectively, is profiled such that a horizontal side length $D_1$ is shorter than a vertical side length $D_2$.

In hydroforming with either the die shown in FIG. 10(*a*1) or the (lie shown in FIG. 10(*b*1), a round metallic tube can not be used, as will be described later.

In the case of the die shown in FIG. 10 (*a*1), the round tube is set on the die cavity 14*a* of the lower die 14, not on the tube holding groove 14*b*. When the upper die 15 is lowered, the tube will be crushed between the die cavities 14*a* and 14*a*.

FIGS. 11(*a*) and 11(*b*) are sectional views showing deformed states of the metallic tube crushed between the lower die 14 and the upper die 15. FIG. 11(*a*) shows a deformed state of the metallic tube within the die cavities, and FIG. 11(*b*) shows a deformed state of the metallic tube within the tube-holding grooves.

As shown in FIG. 11(*a*), when the upper die 15 is lowered while a metallic tube 16 is set in the die cavity, the tube 16 is deformed within the die cavity into a cocoon shape with side-wall bucklings 17. This also causes generation of bucklings 18 on portions of the tube 16 within the tube-holding grooves near the die cavities.

When these bucklings are clamped between the upper and lower dies 15 and 14, a product and the dies 15 and 14 must be damaged.

In order to avoid the occurrence of the bucklings, the round metallic tube must be preformed into a shape which can be inserted within the die cavities and the tube holding grooves.

Also, in the case of the die shown in FIG. 10(*b*1), a round metallic tube must be preformed; otherwise, the die cavities 24*a* and 25*a* cannot contain the metallic tube.

FIGS. 12(*a*1), 12(*a*2), 12(*b*1), and 12(*b*2) are views illustrating the above-mentioned preforming process. FIG. 12(*a*1) is a longitudinal sectional view showing a state in which a round metallic tube 1 is set in a flattening die 30 while plugs 32 are inserted into both ends of the tube. FIG. 12(*a*2) is a sectional view taken along the line 12(*a*2)—12 (*a*2) of FIG. 12(*a*1). FIG. 12(*b*1) is a longitudinal sectional view showing a state in which a punch 31 is lowered from above with an unillustrated press unit to thereby flatten the round metallic tube 1. FIG. 12(*b*2) is a sectional view taken along the line 12(*b*2)—12(*b*2) of FIG. 12(*b*1).

As shown in FIG. 12(*a*1), a die cavity width $D_2'$ of the die 30 is made slightly smaller than the width $D_2$ of the die cavities 14*a* and 15*a* shown in FIGS. 10(*a*2) and 10(*b*2). The plugs 32 are used for prevent deformation of the tube ends which will be held in the tube-holding grooves 14*b* and 15*b* of the dies 14 and 15, respectively. A plug head portion 32*a* has substantially the same diameter as an inside diameter of the tube. The plug 32 is positioned by contacting a flange 32*b* to a tube end.

As shown in FIG. 12(*b*1), a punch 31 is lowered from above with an unillustrated press unit so as to flatten the metallic tube l to a height $D_1'$, yielding a locally flattened tube 33. The height $D_1'$ is made slightly smaller than the die cavity width $D_1$ shown in FIGS. 10(*a*2) and (*b*2). The cross section of a flattened portion 33*a* of the flattened tube 33 becomes a cocoon shape. However, die walls 30*a* prevent the occurrence of the bachklings 17 as shown in FIG. 11(*a*). The plugs 32 also prevent generation of the bucklings 18 as shown in FIG. 11((*b*).

The flattened metallic tube 33 is set in the dies 14 and 15 of FIG. 10(*a*1) or in the dies 24 and 25 of FIG. 10(*b*1) and undergoes hydroforming.

FIGS. 13(*a*1), 13(*a*2), 13(*b*1), and 13(*b*2) are sectional views illustrating a tube hydroforming process conducted through use of the dies 14 and 15 of FIG. 10(*a*1). FIG. 13(*a*1) is a longitudinal sectional view showing the flattened metallic tube 33 set in the dies 14 and 15. FIG. 13(*a*2) is a sectional view taken along the line 13(*a*2)—13(*a*2) of FIG. 13(*a*1). FIG. 13(*b*1) is a longitudinal sectional view showing a state after the completion of hydroforming the flattened metallic tube 33. FIG. 13(*b*2) is a sectional view taken along the line 13(*b*2)—13(*b*2) of FIG. 13(*b*1). As shown in FIG. 13(*a*1), the flattened metallic tube 33 is set in the die cavity 14*a* and in the tube-holding grooves 14*b* of the lower die 14. The upper die 15 is lowered and pressed against the lower die 14 with a predetermined force, and the sealing punches 6 and 7 are advanced from their respective sides so as to insert the punch head portions 6*a* and 7*a* into the end portions of the flattened metallic tube 33, thereby sealing the punches 6 and 7 against corresponding tube ends. The flattened metallic tube 33 is filled with the hydraulic fluid 8. The pressure of the hydraulic fluid 8 is gradually increased so as to expand the flattened portion 33*a* having a cocoon-shaped cross section within the die cavities 14*a* and 15*a*, yielding a product formed along the die profile as shown in FIGS. 13(*b*1) and 13(*b*2).

Two problems are involved in the conventional hydroforming process for obtaining the product 2 or the like described previously with reference to FIGS. 9(*a*1), 9(*a*2), 9(*b*1), 9(*b*2), 9(*c*), and 9(*d*).

A first problem is wall thinning which occurs at four corner portions of a cross section of the expanded portion 2*a* as encircled in FIG. 9(*b*2). As the ratio of a circumferential length S2 of the expanded portion 2*a* of a product 2 to a circumferential length S0 of a metallic tube, S2/S0, increases or as a radius r of a corner portion as shown in the enlarged view of FIG. 9(*c*) decreases, the degree of wall thinning of a corner portion increases. Accordingly, a product may fail to obtain required wall thickness, or excessive wall thinning may cause a rupture 70 at a corner portion as shown in FIG. 9(*d*). At a required corner radius smaller than a critical value, the conventional hydroforming process may be inapplicable especially to a tube material having a relatively high strength, since the ductility of such material is poor.

Through feed of a tube material in tube-holding grooves into a die cavity by axial pressing with the sealing punches 6 and 7, wall thinning at corner portions can be suppressed to some degree. However, when a length L of the expanded portion 2*a* of a product is relatively long, the effect of axial pressing does not reach an axially central section of the expanded portion 2*a*. Thus, a wall thinning problem at corner portions still exists.

According to an experiment conducted by the inventors of the present invention when, for example, a carbon steel tube having a 40 $kgf/mm^2$-class tensile strength is hydroformed into a product whose expanded portion 2*a* has a length L four times a tube diameter $D_0$ and a square cross section with S2/S0=1.25 (S2: circumferential length of the expanded portion 2*a*; S0: circumferential length of the tube), the corner radius r cannot be made less than or equal to 5 times a wall thickness t (see FIG. 9(*c*)).

The degree of wall thinning at a corner portion is larger than that at a flat side portion. This is because during hydroforming expansion an increase in the diameter of a metallic tube is maximized in a diagonal corner-to-corner direction. Flat side portions of a product come into contact with the walls of the die cavities 14*a* and 15*a* at a relatively early stage of hydroforming. Thus, the extensional deformation of the flat side portions in a circumferential direction is suppressed by the friction between the flat side portions and the die cavity walls. This promotes the extensional deformation of corner portions in a circumferential direction.

A second problem is that in hydroforming there must be a relatively high pressure of the hydraulic fluid 8. In the conventional hydroforming process as described previously with reference to FIGS. 9(*a*1), 9(*a*2), 9(*b*1), 9(*b*2), 9(*c*) and 9(*d*), an internal pressure p must be applied to a metallic tube in order to form a corner portion with a radius r as shown in FIG. 9(*c*). The required internal pressure p can be estimated by the following equation.

$$p=(t\times\sigma)/r$$

where t is the wall thickness of a tube material, and σ is the strength of a tube material.

For example, with t=3 mm, σ=50 kgf/mm$^2$, and r=15 mm, p is calculated as 10 kgf/mm$^2$, i.e., a high pressure of 1,000 atm is required for hydroforming. As the pressure of the hydraulic fluid 8 increases, a pressure generator becomes further large-scaled, and a larger force is required for pressing upper and lower dies each other. Accordingly, since die strength must be increased, a hydroforming apparatus becomes expensive, resulting in an increase in hydroforming cost.

Also, two problems are involved in the conventional hydroforming process for obtaining the product 3 or the like described previously with reference to FIGS. 13(*a*1), 13(*a*2), 13(*b*1), and 13(*b*2).

A first problem is the wall thinning of the expanded portion 3*a* of the product 3; particularly, wall thinning which occurs at corner portions of a cross section of the expanded portion 3*a*. In hydroforming as illustrated in FIGS. 13(*a*1), 13(*a*2), 13(*b*1), and 13(*b*2), resistance which arises when a tube material passes through stepped portions 14*c* and 15*c* of the dies 14 and 15, respectively, hinders smooth pushing of the tube material in the tube-holding grooves 14*b* and 15*b* into the die cavities 14*a* and 15*a*. As a result, the degree of wall thinning at corner portions becomes rather large even when a length L of the expanded portion 3*a* is relatively short.

A second problem is a shape defect of a rectangular sectional profile as shown in FIG. 13(*b*2). This problem derives from a metallic tube to be hydroformed with a cocoon shape as shown in FIG. 13(*a*2).

FIGS. 14(*a*) to 14(*c*) illustrate generation of the shape defect. FIG. 14(*a*) is a sectional view showing an initial stage of hydroforming. FIG. 14(*b*) is a sectional view showing an intermediate stage of hydroforming. FIG. 14(*c*) is a sectional view showing a final stage of hydroforming.

As shown in FIG. 14(*a*), in an initial stage of hydroforming, the pressure of the hydraulic fluid 8 causes convex portions 35 of the cocoon shape to come into contact with the walls of the die cavities 14*a* and 15*a*. Subsequently, as the fluid pressure increases, the depth of concave portions 34 decreases gradually. As shown in FIG. 14(*b*), area of the zones 36 in contact with the die cavity walls gradually increases with the increase of the fluid pressure. Due to friction of between the contact zones 36 and the die cavity walls, the concave portions 34 are no longer deformed. While a tube material of corner portions 37 is extending in a circumferential direction, a corner radius r gradually becomes smaller. Since a circumferential material length of the concave portion 34 is excessive, the concave portions 34 cannot be brought into contact with the die cavity walls even when the fluid pressure is increased. As a result, as shown in FIG. 14(*c*), the concave portions 34 remain in a product. The above-mentioned problems are also involved in hydroforming through use of the die shown in FIG. 10(*b*).

SUMMARY OF THE INVENTION

An object of the present invention is to provide a method and an apparatus for hydroforming a metallic tube characterized in that no high fluid pressure is required and a product is free from both wall thinning at its corner portions and a shape defect.

The inventors of the present invention conducted various experiments and intensive studies and found that the above-mentioned problems can be solved through employment of hydroforming consisting of primary hydroforming and secondary hydroforming.

Specifically, in primary hydroforming, a metallic tube is formed such that a circumferential length of an expanded portion of the primary-hydroformed tube as measured at a wall center region of the expanded portion becomes equal to or slightly shorter than a circumferential length of an expanded portion of a product as measured at a wall center region of the expanded portion. In secondary hydroforming, the outer surface of the expanded portion formed through primary hydroforming is mechanically pressed so as to finish the cross-sectional profile of the expanded portion into that of an expanded portion of a product.

Based on the above findings, the present invention was accomplished. The gist of the present invention is as follows.

(1) A method for hydroforming a metallic tube in order to form an expanded portion having an arbitrary cross-sectional profile through application of a fluid pressure into the interior of the metallic tube contained in a pair of upper and lower dies, said method comprising the steps of primary hydroforming and secondary hydroforming, wherein in the primary hydroforming step, the metallic tube is formed such that a circumferential length of an expanded portion of the primary-hydroformed tube becomes substantially equal to or slightly shorter than the circumferential length of an expanded portion of a product and in the secondary hydroforming step, the expanded portion formed through primary hydroforming is pressed by one movable pad at least incorporated within the dies so as to form the cross-sectional profile of the expanded portion into that of the expanded portion of the product, and said primary hydroforming and secondary hydroforming are continuously performed within the dies.

(2) A method for hydroforming a metallic tube in order to form an expanded portion having an arbitrary cross-sectional profile through application of a fluid pressure into the interior of the metallic tube contained in a pair of upper and lower dies, said method comprising the steps of: placing in the dies the metallic tube that has a circumferential length substantially equal to or slightly shorter than a circumferential length of an expanded portion of a product; and pressing the metallic tube by means of one movable pad at least incorporated within the dies, so as to form the cross-sectional profile of the metallic tube into that of the expanded portion of the product.

(3) An apparatus for hydroforming a metallic tube in order to form an expanded portion having an arbitrary cross-sectional profile through application of a fluid pressure into the interior of the metallic tube contained between a lower die attached to a bolster located at a lower portion of the apparatus and an upper die attached to a ram head located at an upper portion of the apparatus, wherein the apparatus comprises one movable pad at least incorporated within the dies, and pressure units contained in the bolster and ram head for pressing the pads.

(4) A tubular part obtained through a hydroforming process for a metallic tube by application of a fluid pressure into the interior of the metallic tube contained in a die, said hydroformation process comprising the steps of primary hydroforming and secondary hydroforming, wherein in the primary hydroforming step, the metallic tube is formed such that a circumferential length of an expanded portion of the primary-hydroformed tube becomes substantially equal to or slightly shorter than a circumferential length of an expanded portion of a product, and in the secondary hydroforming step, the expanded portion formed through primary hydroforming is pressed so as to form the cross-sectional profile of the expanded portion into that of the expanded portion of the product.

(5) A tubular part obtained through a hydroforming process comprising the steps of; placing into dies a metallic tube that has a circumferential length ubstantially equal to or slightly shorter than a circumferential length of an expanded portion of a product; and applying a fluid pressure into the interior of the metallic tube; and pressing the metallic tube by means of one movable pad at least incorporated within the die so as to form the cross-sectional profile of the metallic tube into that of the expanded portion of the product.

BRIEF DESCRIPTION OF THE DRAWINGS

FIG. 1(*b*) is a sectional view taken along the line 1(*b*)—1(*b*) of FIG. 1(*a*);

FIG. 2(*a*2) is a sectional view taken along the 2(*a*2)—2(*a*) line of FIG. 2(*a*1);

FIG. 2(*b*1) is a longitudinal sectional view showing a state of the metallic tube being primary-hydroformed, illustrating the first embodiment;

FIG. 2(*b*2) is a sectional view taken along the 2(*b*2)—2(*b*2) line of FIG. 2(*b*1);

FIG. 2(*c*1) is a longitudinal sectional view showing a state of the metallic tube being secondary-hydroformed, illustrating the first embodiment;

FIG. 2(*c*2) is a sectional view taken along the 2(*c*2)—2(*c*2) line of FIG. 2(*c*);

FIG. 3(*a*2) is a sectional view taken along the 3(*a*2)—3(*a*2) line of FIG. 3(*a*1);

FIG. 3(*b*1) is a longitudinal sectional view showing a state of the metallic tube being primary-hydroformed, illustrating the second embodiment;

FIG. 3(*b*2) is a sectional view taken along the 3(*b*2)—3(*b*2) line of FIG. 3(*b*1);

FIG. 3(*c*1) is a longitudinal sectional view showing a state of the metallic tube being secondary-hydroformed, illustrating the second embodiment;

FIG. 3(*c*2) is a sectional view taken along the 3(*c*2)—3(*c*2) line of FIG. 3(*d*);

FIG. 5(*b*) is a sectional view showing an expanded portion of the product;

FIG. 5(*c*) is a sectional view showing another expanded portion of the product;

FIG. 7(*a*2) is a front view showing the metallic tube of FIG. 7(*a*1);

FIG. 7(*b*1) is a side view showing a product obtained through tube hydroforming;

FIG. 7(*b*2) is a front view showing the product of FIG. 7(*b*1);

FIG. 7(*c*1) is a side view showing another product obtained through tube hydroforming;

FIG. 7(*c*2) is a front view showing the product of FIG. 7(*c*1);

FIG. 8(*b*) is a sectional view taken along the line 8(*b*)—8(*b*) of FIG. 8(*a*);

FIG. 9(*a*2) is a sectional view taken along the line 9(*a*2)—9(*a*2) of FIG. 9(*a*1);

FIG. 9(*b*1) is a longitudinal sectional view showing a state after the completion of conventional hydroforming;

FIG. 9(*b*2) is a sectional view taken along the line 9(*b*2)—9(*b*2) of FIG. 9(*b*1);

FIG. 9(*c*) is an enlarged view showing the encircled portion a of FIG. 9(*b*2);

FIG. 9(*d*) is a perspective view showing a product ruptured during conventional hydroforming;

FIG. 10(*a*2) is a sectional view taken along the line 10(*a*2)—10(*a*2) of FIG. 10(*a*1);

FIG. 10(*b*1) is a longitudinal sectional view showing still another die for conventional hydroforming use;

FIG. 10(*b*2) is a sectional view taken along the line 10(*b*2)—10(*b*2) of FIG. 10(*b*1);

FIG. 11(*b*) is a sectional view showing another buckling trouble involved in conventional hydroforming;

FIG. 12(*a*2) is a sectional view taken along the line 12(*a*2)—12(*a*2) of FIG. 12(*a*1);

FIG. 12(*b*1) is a longitudinal sectional view showing a flattened metallic tube;

FIG. 12(*b*2) is a sectional view taken along the line 12(*b*2)—12(*b*2) of FIG. 12(*b*1);

FIG. 13(*a*2) is a sectional view taken along the line 13(*a*2)—13(*a*2) of FIG. 13(*a*1);

FIG. 13(*b*1) is a longitudinal sectional view showing a state after the completion of hydroforming the flattened metallic tube of FIG. 13(*a*1);

FIG. 13(*b*2) is a sectional view taken along the line 13(*b*2)—13(*b*2) of FIG. 13(*b*1);

FIG. 14(*b*) is a sectional view showing an intermediate stage of hydroforming, illustrating generation of a concave shaped defect; and FIG. 14(*c*) is a sectional view showing a final stage of hydroforming, illustrating generation of a concave shaped defect.

DETAILED DESCRIPTION OF THE INVENTION

Figure 1A:
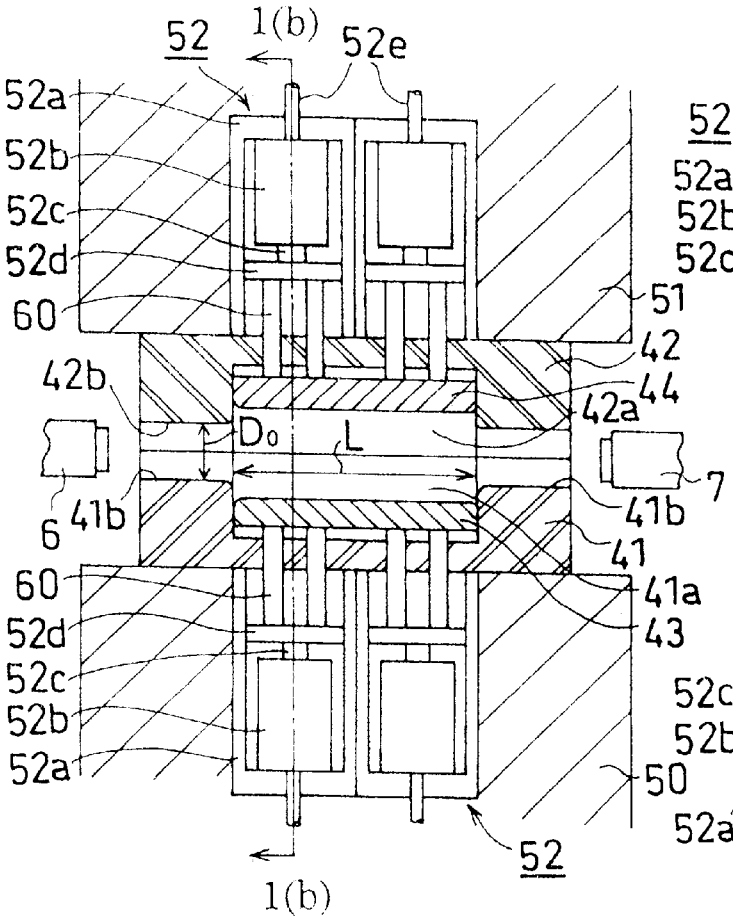
FIG. 1(*a*) is a longitudinal sectional view showing an embodiment of a hydroforming apparatus of the present invention.
Figure 1B:
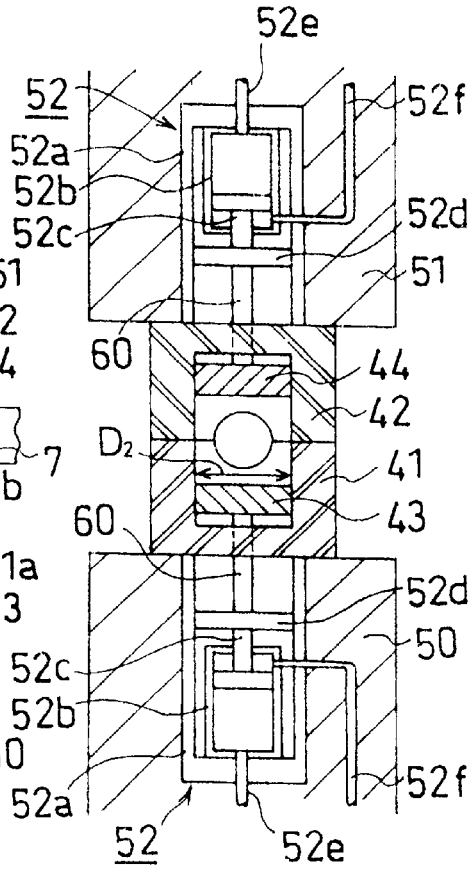

FIGS. 1(*a*) and 1(*b*) are sectional views showing an embodiment of a hydroforming apparatus of the present invention. FIG. 1(*a*) is a longitudinal sectional view of the apparatus, and FIG. 1(*b*) is a sectional view taken along the line 1(*b*)—1(*b*) of FIG. 1(*a*).

A die is composed of a lower die 41 and an upper die 42. The lower die 41 is attached to a bolster 50 of an unillustrated press unit. The upper die 42 is attached to a ram head 51 of the unillustrated press unit.

The ram head 51 is moved vertically by an unillustrated hydraulic cylinder, thereby pressing the upper die 42 against the lower die 41 with a predetermined force. The bolster 50 and the ram head 51 respectively contain pressure units 52 in a vertically opposing manner.

In FIG. 1(*a*), two pressure units 52 are installed in each of the bolster 50 and the ram head 51. However, the number of the pressure units 52 is not particularly limited. Each of the pressure units 52 includes a case 52*a*, a cylinder 52*b*, a piston rod 52*c*, and a piston head 52*d*. A hydraulic fluid is fed into the cylinder 52*b* from an unillustrated pump through a line 52*e* or 52*f* to thereby move the piston rod 52*c* vertically. Accordingly, the piston head 52*d* is moved vertically while being guided along the inner walls of the case 52*a*.

The lower die 41 and the upper die 42 have die cavities (spaces formed in the dies) 41*a* and 42*a* and tube holding grooves 41*b* and 42*b* formed respectively therein in a vertically opposing manner. The die cavities 41*a* and 42*a* contain pads 43 and 44, respectively. A space defined by the side walls of the die cavities 41*a* and 42*a* and the pads 43 and 44 is used to form an expanded portion of a product. Specifically, a length L and a width $D_2$ of the die cavities 41*a* and 42*a* are respectively identical to the length and width of an expanded portion 2*a* (3*a*) of the product of FIG. 7(*b*1) (FIG. 7(*d*)) A diameter $D_0$ of the tube-holding grooves 41*b* and 42*b* is identical to the outer diameter of a metallic tube 1. Pins 60 are set between the pads 43 and 44 and the upper and lower piston heads 52*d*. As the piston rods 52*c* move vertically, the pads 43 and 44 also move vertically. The upper pad 44 and the upper pins 60 are connected to, for example, the piston head 52*d* located on the ram head side, in order to prevent the pad 44 and the pins 60 from dropping.

The secondary hydroforming can be carried out with only a single pad either upper pad 44 or lower pad 43, and also with several pads of upper and/or lower pad.

Figure 2:
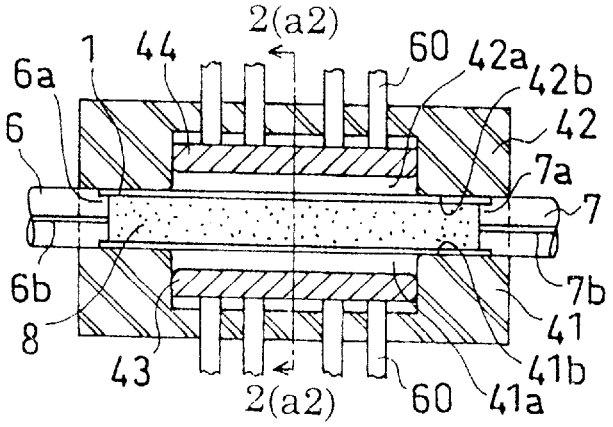
FIG. 2(*a*1) is a longitudinal sectional view showing a state of a metallic tube being set in a die portion of the apparatus of FIG. 1(*a*), illustrating a first embodiment of a hydroforming method of the present invention.
Figure 2:
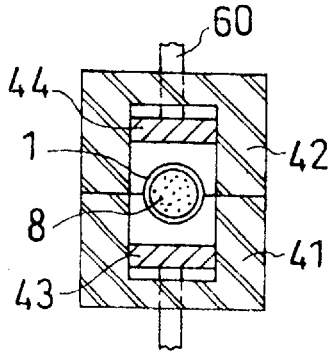
Figure 2:
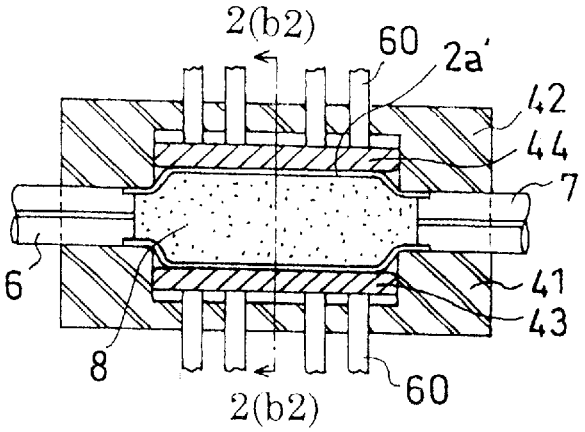
Figure 2:
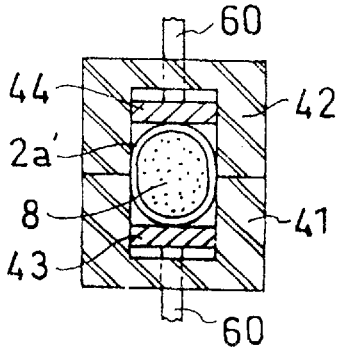
Figure 2:
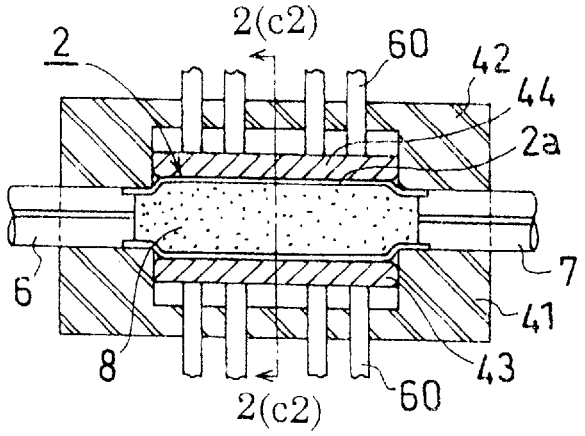
Figure 2:
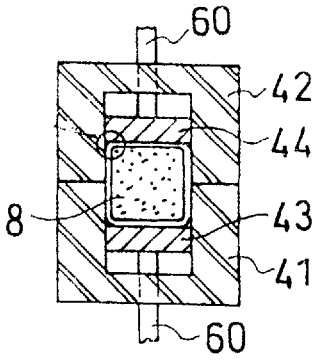

FIGS. 2(*a*1), 2(*a*2), 2(*b*1), 2(*b*2), 2(*c*1), and 2(*c*2) are views showing a die portion of the apparatus of FIG. 1(*a*), illustrating a method for hydroforming a metallic tube through use of the apparatus so as to obtain a product 2. FIGS. 2(*a*1), 2(*b*1), and 2(*c*1) are longitudinal sectional views showing the state of a metallic tube being set in the upper and lower dies, the state of the metallic tube being primary-hydroformed, and a state of the metallic tube being secondary-hydroformed, respectively. FIGS. 2(*a*2), 2(*b*2), and 2(*c*2) are sectional views taken along the 2(*a*2)—2(*a*2), 2(*b*2)—2(*b*2) and 2(*c*2)—2(*c*2) lines of FIGS. 2(*a*1), 2(*b*1), and 2(*c*1), respectively.

The metallic tube 1 is set in the tube-holding grooves 41*b* of the lower die 41. An unillustrated ram head is lowered from above so as to press the upper die 42 against the lower die 41 attached to an unillustrated bolster with a predetermined force. Sealing-punch 6 and 7 are advanced from their respective sides so that head portions 6*a* and 7*a* of the sealing-punch 6 and 7, respectively, are tightly inserted into the end portions of the metallic tube 1, thereby the tube ends are sealed during hydroforming. Next, while a hydraulic fluid 8 is introduced into the metallic tube 1 by means of an unillustrated pump through a path 6*b* extending through the left-hand sealing punch 6, air inside the metallic tube 1 is ejected through a path 7*b* extending through the right-hand sealing punch 7, thereby filling the interior of the metallic tube 1 with the hydraulic fluid 8.

Subsequently, primary hydroforming is performed. The pressure of the hydraulic fluid 8 is increased advancing the sealing-punch 6 and 7 to press,the metallic tube 1 axially, thereby primary-expanding the tube material within the die cavities 41*a* and 42*a* (FIG. 2(*a*1)) as shown in FIGS. 2(*b*1) and 2(*b*2). The primary expansion is performed such that a circumferential length of a primary expanded portion 2*a*' becomes equal to or slightly shorter than a circumferential length of the expanded portion 2*a* of the product 2 of FIG. 7(*b*1).

A circumferential length of a primary expanded portion is made equal to or slightly shorter than a circumferential length of an expanded portion of a product for the following reason. If a circumferential length of a primary expanded portion is longer than that of an expanded portion of a product, a shape defect, such as wrinkles, will occur in secondary hydroforming. In the case that a circumferential length of a primary expanded portion is made slightly shorter than a circumferential length of an expanded portion of a product, the circumferential length of the primary expanded portion is made about 2% to 3% shorter than that of the product. This about 2%–3% shortage in the circumferential length of the primary expanded portion can be removed through further expansion of the primary expanded portion effected by increasing the fluid pressure in secondary hydroforming, thereby obtaining the circumferential length of the expanded portion of the product. In the case of an about 2%–3% length shortage in primary hydroforming, wall thinning involved in expansion effected by secondary hydroforming is negligible. However, in this case, since fluid pressure must be increased, the hydroforming apparatus must be designed accordingly.

The primary expanded portion 2*a*' has an elliptical cross-sectional profile. The elliptical shape is selected so that the entire cross section can be extended in a circumferential direction as uniformly as possible. The cross-sectional profile is not particularly limited. Since the radius of a round section of the expanded portion 2*a*' is greater than the corner radius of the expanded portion 2*a* of the product 2, fluid pressure for primary hydroforming can be made relatively small.

Subsequently, the pressure of the hydraulic fluid 8 is adjusted to a secondary hydroforming pressure, which will be described later, to thereby perform secondary hydroforming. Specifically, the pressure units 52 of FIG. 1 are activated, so that the primary expanded portion 2*a*' is pressed from above and from underneath with the pads 43 and 44 via the pins 60 as shown in FIG. 2(*c*1) Thus, the cross-sectional profile of the primary expanded portion 2*a*' is formed to that of the expanded portion 2*a* of the product 2.

Figure 12:
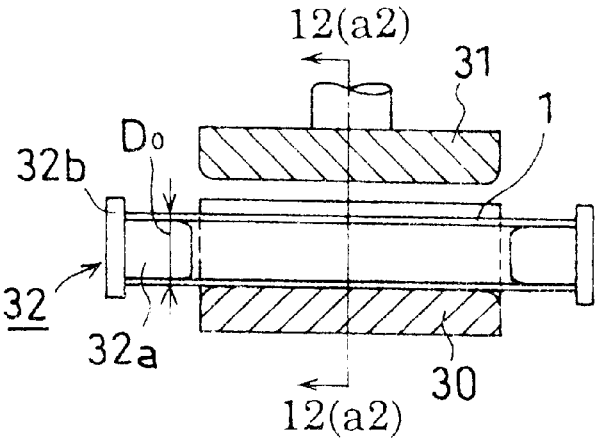
FIG. 12(*a*1) is a longitudinal sectional view showing a metallic tube to be flattened.
Figure 12:
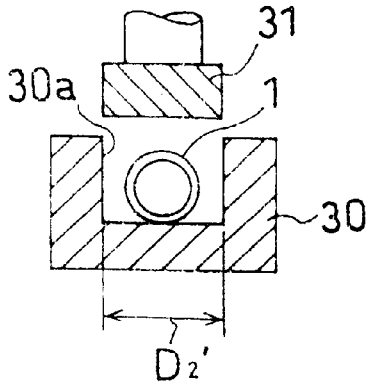
Figure 12:
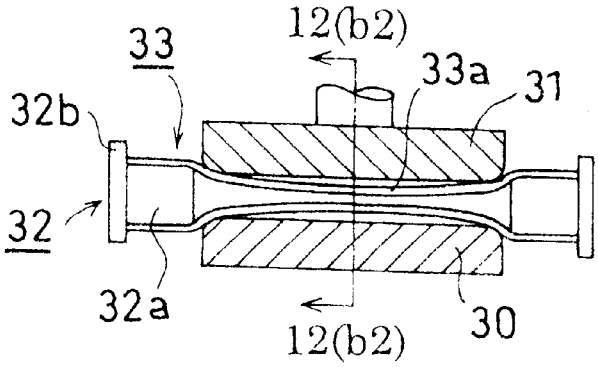
Figure 12:
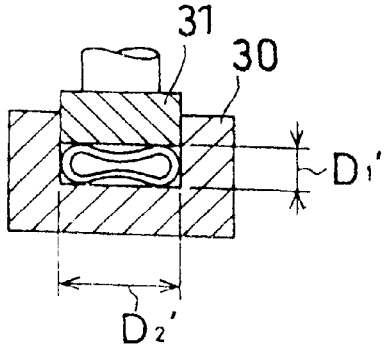

In the above-mentioned secondary hydroforming, the tubular material is supported from inside by the pressure of the hydraulic fluid 8. Accordingly, the cross-sectional profile is not deformed to a cocoon shape as shown in FIG. 12(*b*2). In other words, fluid pressure for secondary hydroforming may be to such a degree as to prevent deformation to a cocoon shape, specifically 100–200 atm, for example.

Figure 3:
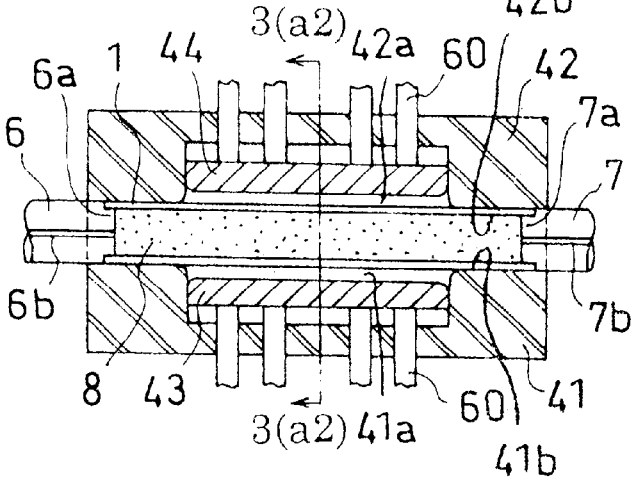
FIG. 3(*a*1) is a longitudinal sectional view showing a state of a metallic tube being set in a die portion of the apparatus of FIG. 1(*a*), illustrating a second embodiment of a hydroforming method of the present invention.
Figure 3:
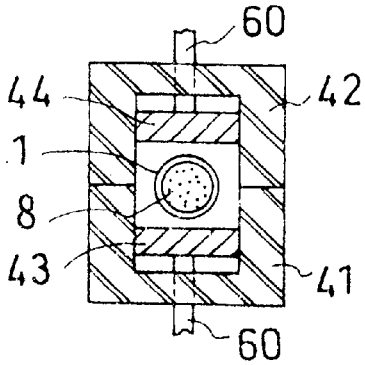
Figure 3:
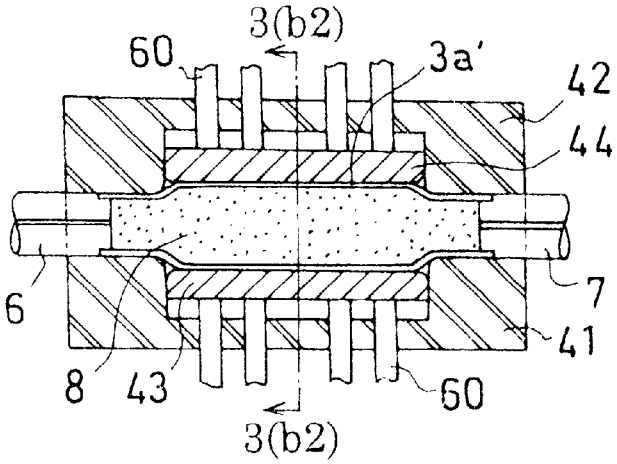
Figure 3:
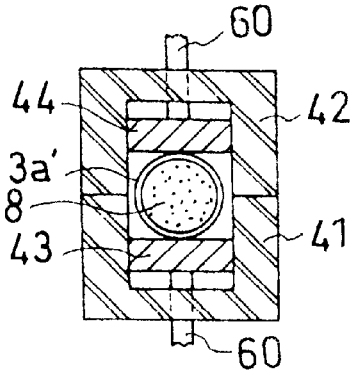
Figure 3:
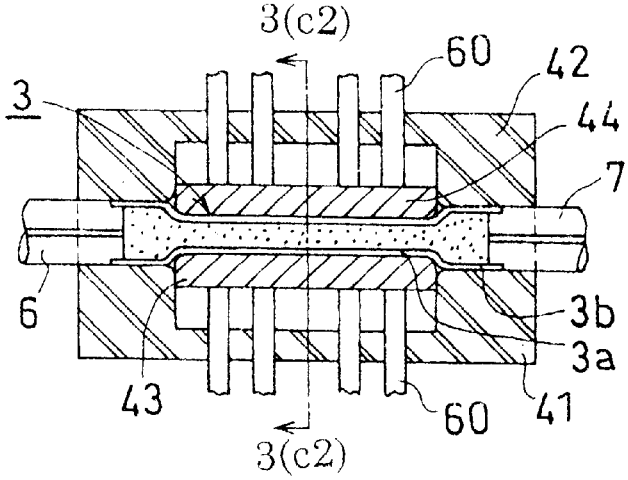
Figure 3:
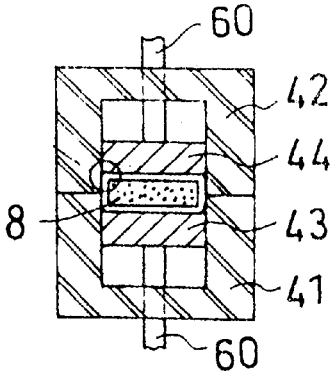

A required circumferential length of an expanded portion of a product is already obtained in primary hydroforming. Accordingly, corner portions of a cross section of the product's expanded portion are formed through bending deformation, not through fluid pressure. Thus, the hydroforming method of the present invention has a significant advantage that it can not only suppress wall thinning at corner portions but also obtain a relatively small corner radius with a relatively low fluid pressure. FIGS. 3(*a*1), 3(*a*2), 3(*b*1), 3(*b*2), 3(*c*1), and 3(*c*2) are views showing a die portion of the apparatus shown in FIG. 1(*a*), illustrating another method for hydroforming a metallic tube through use of the apparatus so as to obtain a product 3. FIGS. 3(*a*1), 3(*b*1), and 3(*d*) are longitudinal sectional views showing a state of a metallic tube being set in the upper and the lower dies, a state of the metallic tube being primary-hydroformed, and a state of the metallic tube being secondary-hydroformed, respectively. FIGS. 3(*a*2), 3(*b*2), and 3(*c*2) are sectional views taken along the 3(*a*2)—3(*a*2), 3(*b*2)—3(*b*2) and 3(*c*2)—3(*c*2) lines of FIGS. 3(*a*1), 3(*b*1), and 3(*c*1), respectively.

The metallic tube 1 is set in the tube-holding grooves 41*b* of the lower die 41. An unillustrated ram head is lowered from above so as to press the upper die 42 against t he lower die 41 attached to an unillustrated bolster with a predetermined force. Sealing-punch 6 and 7 are advanced from their respective sides so that head portions 6*a* and 7*a* of the sealing-punch 6 and 7, respectively, are tightly inserted into the end portions of the metallic tube 1, thereby the tube ends are sealed during hydroforming. Next, while a hydraulic fluid 8 is introduced into the metallic tube 1 by means of an unillustrated pump through a path 6*b* extending through the left-hand sealing punch 6, air inside the metallic tube 1 is ejected through a path 7*b* extending through the right-hand sealing punch 7, thereby filling the interior of the metallic tube 1 with the hydraulic fluid 8.

Subsequently, primary hydroforming is performed. The pressure of the hydraulic fluid 8 is increased advancing the sealing-punch 6 and 7 to press the metallic tube axally, thereby primary-expanding the tube material within the die cavities 41*a* and 42*a* (FIG. 3(*a*1)) as shown in FIGS. 3(*b*1) and 3(*b*2). The primary expansion is performed such that a circumferential length of a primary expanded portion 3*a*' as measured at a wall center region of the expanded portion 3*a*' becomes equal to or slightly shorter than the circumferential length of the expanded portion 3*a* of the product 3 of FIG. 7(*c*1) as measured at a wall center region of the expanded portion 3*a*.

Accordingly, when the circumferential length of the metallic tube 1 is identical to that of the expanded portion 3*a* of the product 3, primary hydroforming as shown in FIG. 3(*b*1) is unnecessary.

The primary expanded portion 3*a*' in FIG. 3(*b*2) has a circular cross-sectional profile. The circular shape is selected so that the entire cross section can be extended in a circumferential direction as uniformly as possible. The cross-sectional profile is not particularly limited. Since the radius of the expanded portion 3*a*' is greater than the corner radius of the expanded portion 3*a* of the product 3, fluid pressure for primary hydroforming can be made relatively small.

Subsequently, the pressure of the hydraulic fluid 8 is set to a secondary hydroforming pressure, to thereby perform secondary hydroforming. Specifically, the pressure units 52 of FIG. 1 are activated, so that the primary expanded portion 3*a*' is pressed from above and from underneath with the pads 43 and 44 via the pins 60 as shown in FIG. 3(*c*1). Thus, the cross-sectional profile of the primary expanded portion 3*a*' is formed to that of the expanded portion 3*a* of the product 3.

In the above-mentioned secondary hydroforming, the tubular material is supported from inside by the pressure of the hydraulic fluid 8. Accordingly, the cross-sectional profile is not deformed to a cocoon shape as shown in FIG. 12(*b*2). The fluid pressure for secondary hydroforming may be low pressure, specifically 100–200 atm for example, because the pressure is only required to prevent the occurrence of a cocoon shape. Also, in this case, since a required circumferential length of an expanded portion of a product is already obtained in primary hydroforming, a required cross-sectional corner radius of a product's expanded portion can be obtained at a relatively low fluid pressure while wall thinning at corner portions is suppressed.

As describe above, according to the present invention, when hydroforming is performed to obtain the products 2 and 3 and like products, wall thinning at corner portions of a cross section of an expanded portion can be suppressed. Thus, even when a tube material having a relatively high strength and poor ductility is hydroformed, the corner radius of a product's expanded portion can be finished to a relatively small value.

Also, since the pressure of hydraulic fluid required is relatively low, the cost of hydroforming equipment becomes comparatively low, thereby reducing hydroforming cost. Further, according to the present invention, hydroforming for obtaining the product 3 does not require a flattening process for a metallic tube as shown in FIGS. 12(*a*1) and 12(*b*1). Accordingly, the obtained product 3 is free from a concave shaped defect shown in FIG. 14(*c*)

Figure 7:
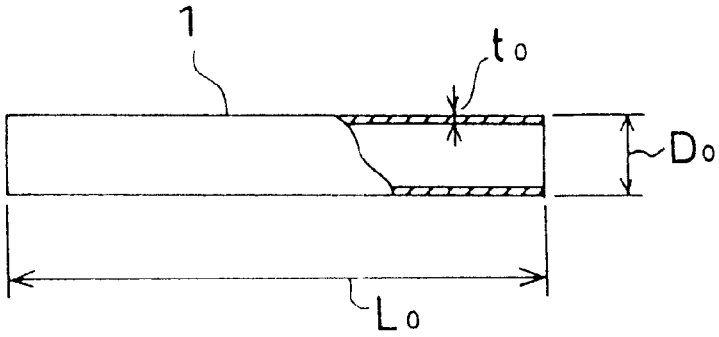
FIG. 7(*a*1) is a side view showing a metallic tube to be hydroformed.
Figure 7:
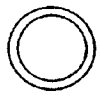
Figure 7:
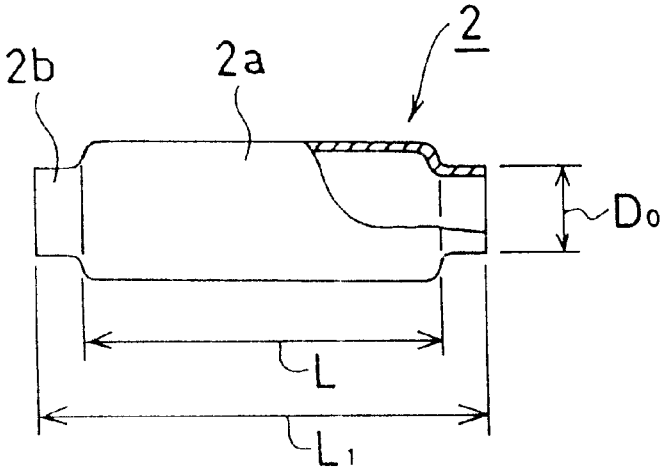
Figure 7:
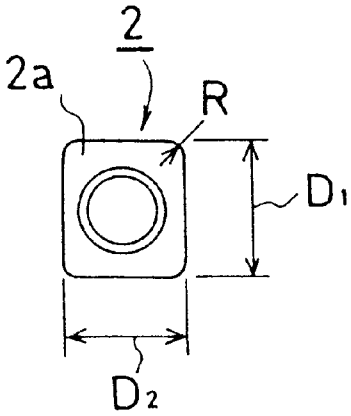
Figure 7:
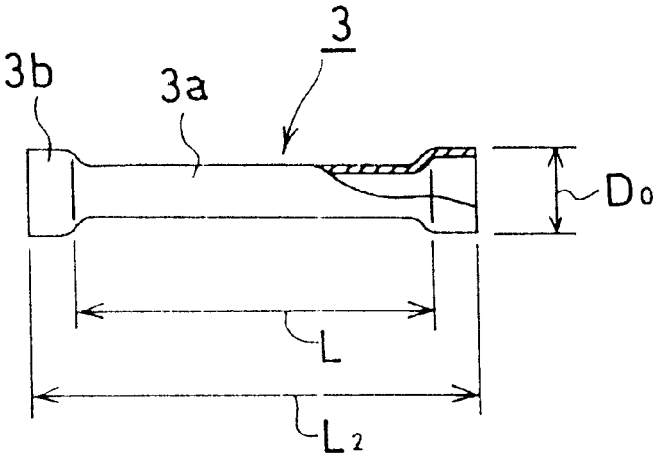
Figure 7:
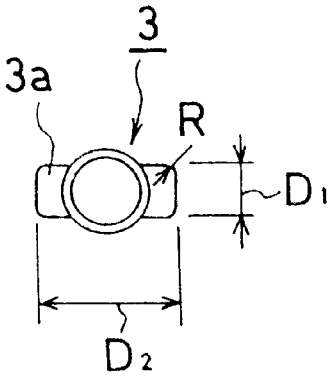
Figure 8A:
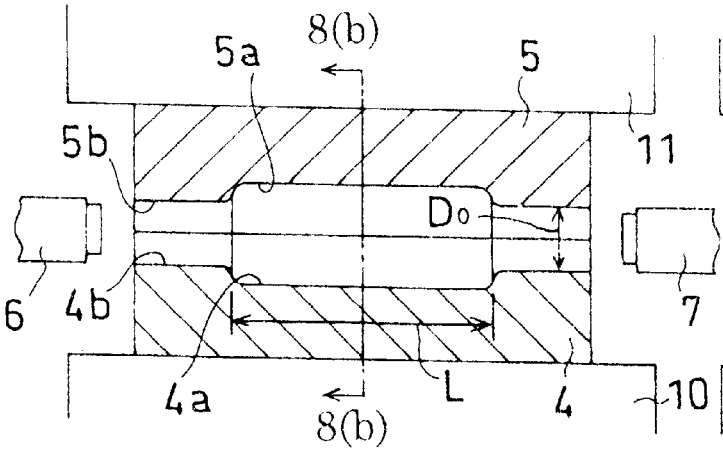
FIG. 8(*a*) is a longitudinal sectional view showing dies for conventional hydroforming use.
Figure 8B:
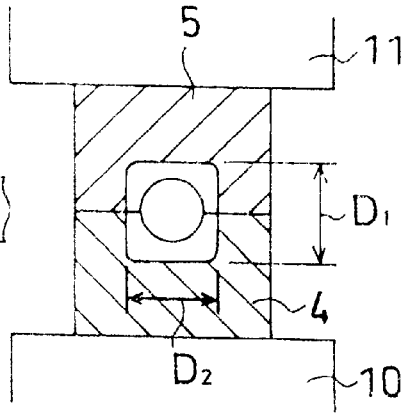

Tubular parts according to the present invention are not limited to those whose expanded portions have rectangular cross sections as shown in FIGS. 7(*b*2) and 7(*c*2).

Figure 4:
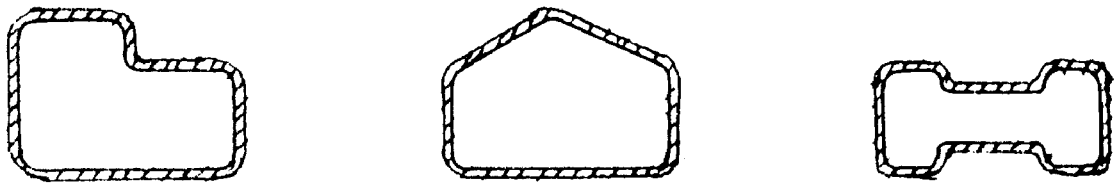
FIG. 4 is a sectional view showing an example cross section of an expanded portion of a hydroformed product.

FIGS. 4(*a*) to 4(*c*) show example cross sections of expanded portions of tubular parts according to the present invention. Even these special-shaped products can be obtained through selection of corresponding pad shapes and die cavity shapes.

Tubular parts according to the present invention are not limited to linear pro ducts as shown in FIGS. 7(*b*1) and 7(*c*1).

Figure 5A:
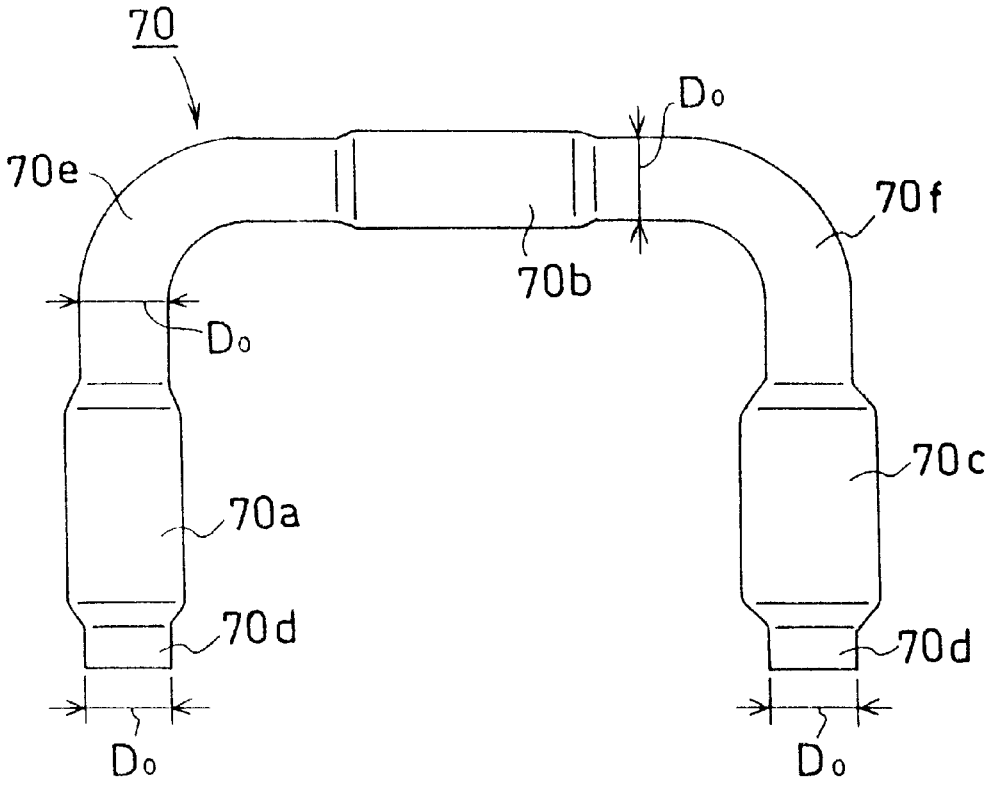
FIG. 5(*a*) is a plan view showing a bent hydroformed product having a plurality of expanded portions formed in a longitudinal direction.
Figure 5A:
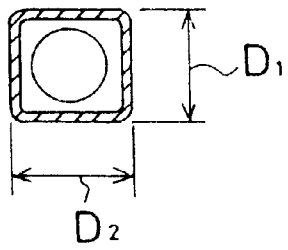
Figure 5C:
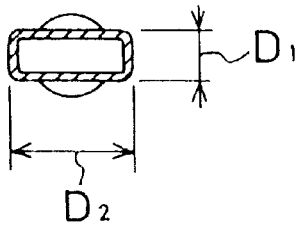

FIGS. 5(*a*), 5(*b*), and 5(*c*) show an example of a bent hydroformed product. FIG. 5(*a*) is a plan view of the product. FIG. 5(*b*) is a sectional view showing an expanded portion of the product. FIG. 5(*c*) is a sectional view showing another expanded portion of the product.

The present invention is applicable to the hydroforming of a bent product such as the product 70 shown in FIG. 5. The product 70 includes a plurality of expanded portions 70*a*, 70*b*, and 70*c* and cylindrical portions 70*d*, 70*e*, and 70*f* having the same diameter as that of a metallic tube. FIG. 5(*b*) shows a cross section of the cylindrical portion 70*b*. FIG. 5(*c*) shows a cross section of the cylindrical portion 70*c*.

Figure 6:
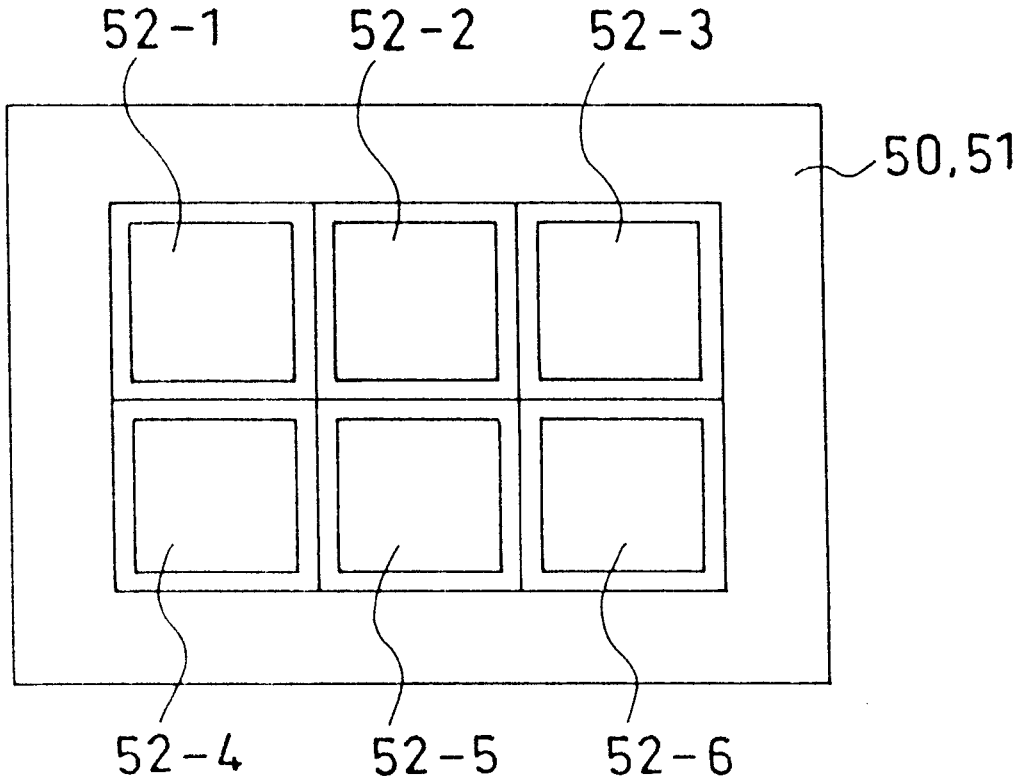
FIG. 6 is a plan view showing the arrangement of pressure units attached to a bolster and to a ram head.

FIG. 6 is an example of a plan view showing the arrangement of pressure units attached to a bolster and to a ram head of a hydroforming apparatus for forming a bent product.

A hydroforming apparatus for hydroforming a bent product includes a bolster 50 and a ram head 51 as shown in FIG. 6. A plurality of pressure units 52-1 to 52-6 are attached to the bolster 50 and to the ram head 51 and arranged as shown in FIG. 6. In order to hydroform a product having a plurality of expanded portions, a plurality of pressure units corresponding to the expanded portions may be used. For example, in order to hydroform the product 70 of FIG. 5(*a*), the pressure units 52-4, 52-2, and 52-6 corresponding to the expanded portions 70*a*, 70*b*, and 70*c* may be activated.

The pressure units can be controlled independently of each other so as to independently control their applied pressures and strokes as needed.

A metallic tube may be of any metal, such as steel, aluminum, copper, or the like.

EXAMPLES

Example 1

The product 2 of FIG. 7(*b*1) was hydroformed. Product dimensions were as follows: $D_1$=90 mm; $D_2$=90 mm; R=6 mm; L=400 mm, $L_1$=500 mm; $D_0$=89.1 mm.

A hydroforming apparatus having the bolster 50 and the ram head 51 as shown in FIG. 1 was used to carry out a hydroforming method of the present invention. Each of the bolster 50 and the ram head 51 had two built-in pressure units 52. Each pressure unit 52 had a maximum thrust of 40 tons an a maximum stroke of 100 mm.

The metallic tube 1 was a steel tube for machine purposes, STKM12A (JIS G 3445), and had an outer diameter of 89.1 mm, a wall thickness of 2.3 mm, and a length $L_0$ of 600 mm. The metallic tube 1 was set in the lower die 41 as shown in FIG. 2(*a*1). The upper die 42 was pressed against the lower die 41 with a die clamping force of 150 tons. The sealing punches 6 and 7 were sealed against corresponding tube ends. The metallic tube 1 was filled wit h the hydraulic fluid 8, which was an emulsion prepared by dispersing a fat-and-oil component in water in an amount of 3%. Next, as shown in FIG. 2(*b*1), while the sealing punches 6 and 7 were being advanced, the pressure of the hydraulic fluid 8 was increased to 300 atm. Thus, primary hydroforming was performed to thereby form the expanded portion 2*a*' having a circumferential length of 350 mm. A maximum axial force was 40 tons. The primary expanded portion 2*a*' had an elliptical cross section having a minimum diameter of 90 mm and a maximum diameter of 124 mm.

Next, after the fluid pressure was reduced to 150 atm, the pressure units 52 were activated so as to press the primary expanded portion 2*a*' in a direction of its major axis with the upper and lower pads 43 and 44. Thus, secondary hydroforming was performed to thereby obtain the expanded portion 2*a* having a square cross section measuring a height and a width of 90 mm as shown in FIG. 2(*c*1), yielding the product 2. The corner radius R of a cross section of the expanded portion 2*a* was 6 mm as required. A minimum wall thickness was 2.0 mm, which satisfied a required wall thickness of 1.8 mm for the product 2.

Figure 9:
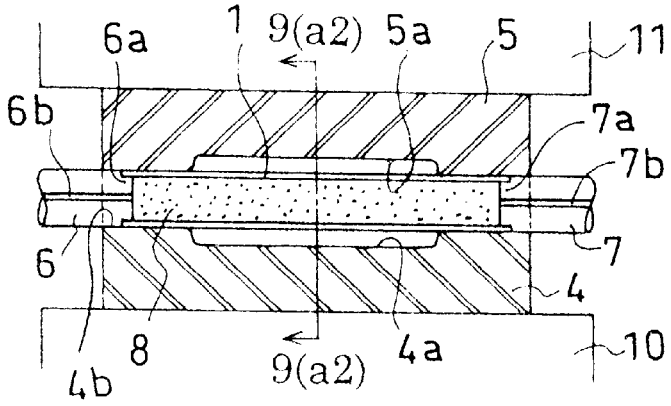
FIG. 9(*a*1) is a longitudinal sectional view showing a metallic tube set in a die, illustrating conventional hydroforming.
Figure 9:
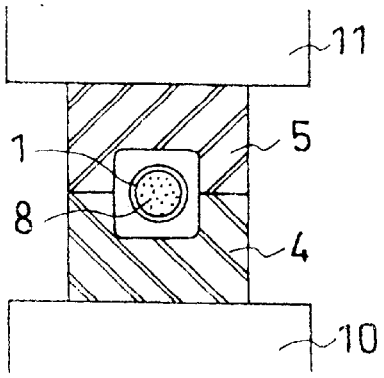
Figure 9:
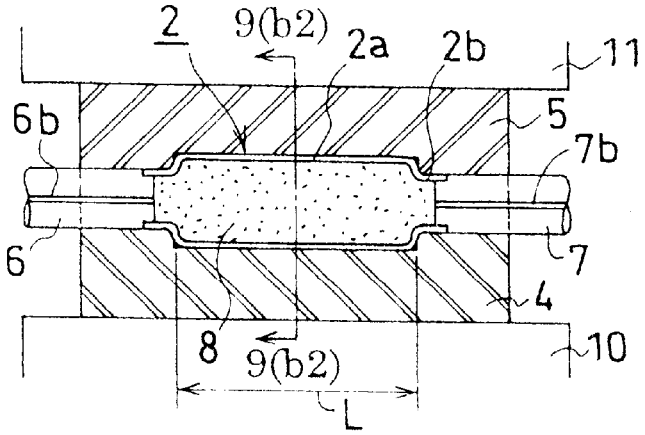
Figure 9:
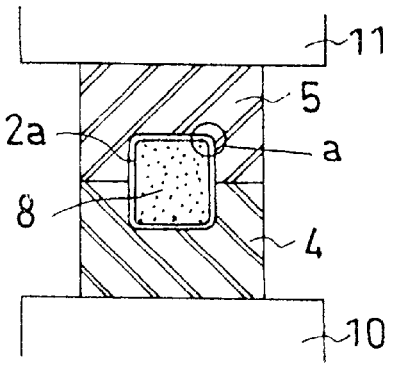
Figure 9C:
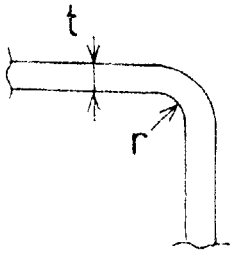
Figure 9D:
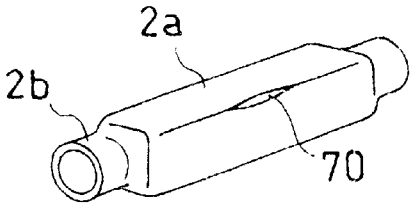
Figure 10:
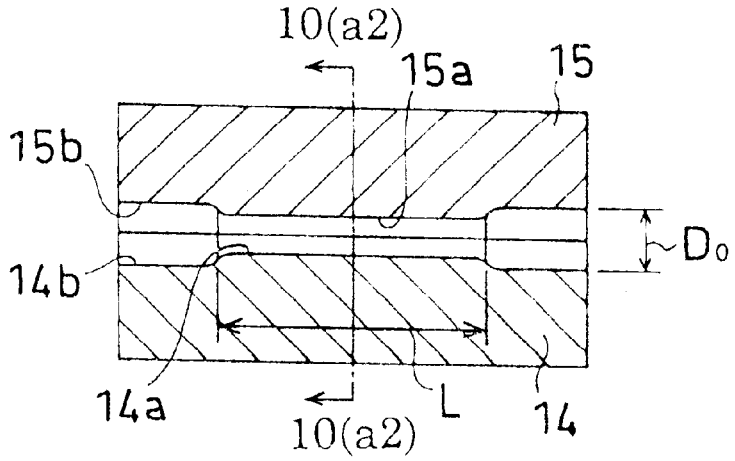
FIG. 10(*a*1) is a longitudinal sectional view showing another die for conventional hydroforming use.
Figure 10:
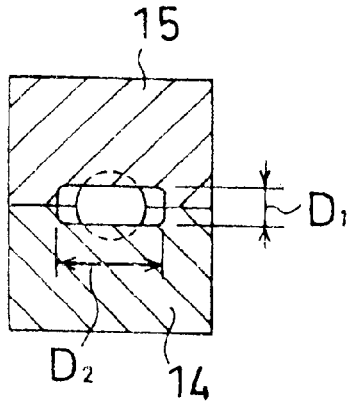
Figure 10:
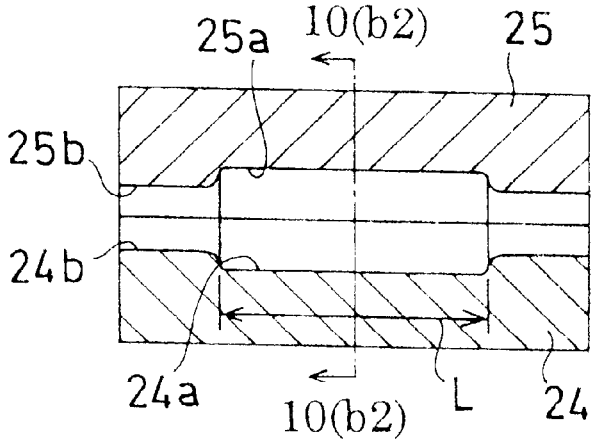
Figure 10:
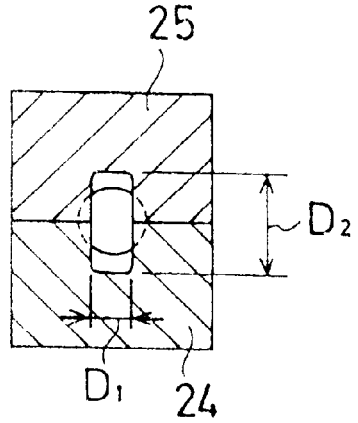
Figure 11A:
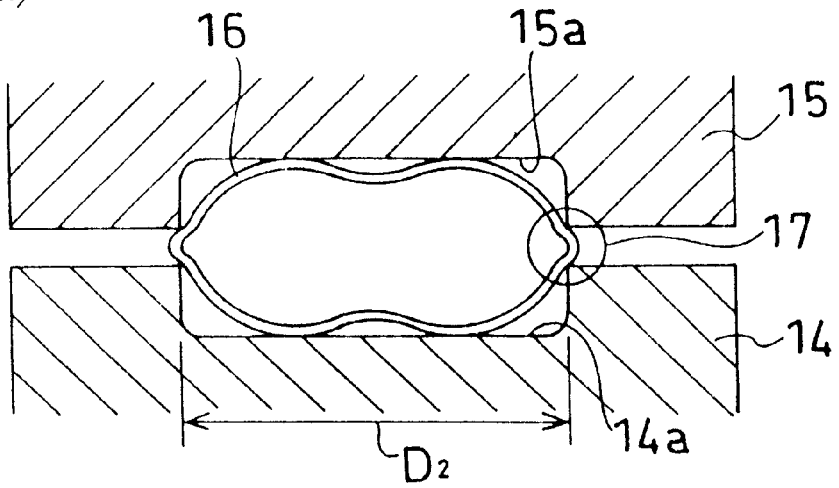
FIG. 11(*a*) a sectional view showing a buckling trouble involved in conventional hydroforming.
Figure 11B:
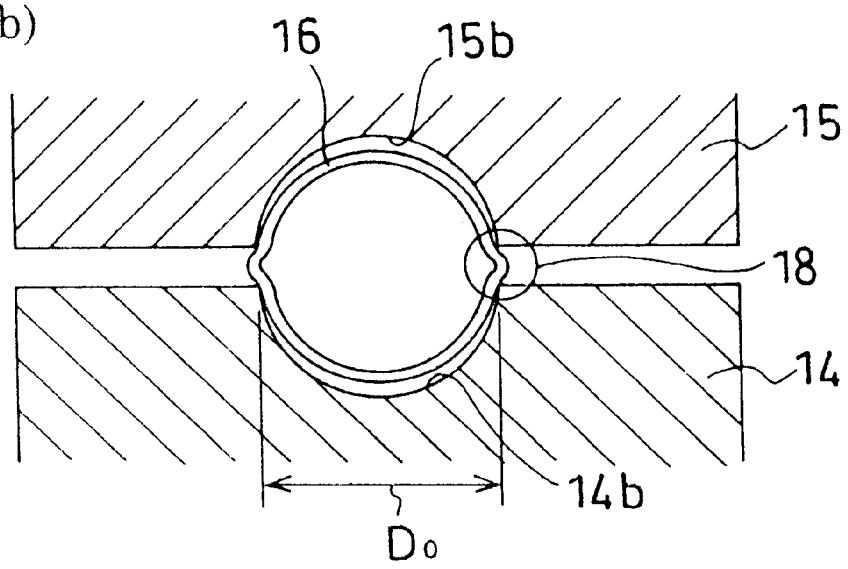

A metallic tube similar to the above metallic tube 1 was hydroformed according to a conventional hydroforming method. As shown in FIG. 9(*a*1), the metallic tube was set in the lower die 4. The upper die 5 was pressed against the lower die 4 with a die clamping force of 450 tons. The sealing punches 6 and 7 were sealed against corresponding tube ends. The metallic tube was filled with the hydraulic fluid 8, which was an emulsion prepared by dispersing a fat-and-oil component in water in an amount of 3%. Next, as shown in FIG. 9(*b*1), the pressure of the hydraulic fluid 8 was increased to 900 atm advancing the sealing-punch 6 and 7, thereby forming the expanded portion 2*a*. A maximum axial force was 80 tons. The corner radius R of a cross section of the expanded portion 2*a* was 14 mm. A minimum wall thickness of the expanded portion 2*a* was 1.8 mm, which was a required wall thickness for the product 2. Since a further increase in fluid pressure causes a failure to meet the target wall thickness of the product 2, a target corner radius of 6 mm of the product 2 could not be attained.

As described above, the hydroforming method of the present invention was smaller in die clamping force, axial force, and fluid pressure than the conventional hydroforming method. Further, the corner radius of a cross section of an expanded portion could be made smaller than in the case of the conventional method.

Example 2

The product 3 of FIG. 7(*c*1) was hydroformed. Product dimensions were as follows: $D_1$=50 mm; $D_2$=137 mm; R=14 mm; L=400 mm, $L_1$=500 mm; $D_0$=89.1 mm.

A hydroforming apparatus having the bolster 50 and the ram head 51 as shown in FIG. 1 was used to carry out a hydroforming method of the present invention. Each of the bolster 50 and the ram head 51 had two built-in pressure units 52. Each pressure unit 52 had a maximum thrust of 40 tons an a maximum stroke of 100 mm.

The metallic tube 1 was a steel tube for machine purposes, STKM12A (JIS G 3445), and had an outer diameter of 89.1 mm, a wall thickness of 2.0 mm, and a length $L_0$ of 600 mm. The metallic tube 1 was set in the lower die 41 as shown in FIG. 3(*a*1). The upper die 42 was pressed against the lower die 41 with a die clamping force of 150 tons. The sealing punches 6 and 7 were sealed against corresponding tube ends. The metallic tube 1 was filled with the hydraulic fluid 8, which was an emulsion prepared by dispersing a fat-and-oil component in water in an amount of 3%. Next, as shown in FIG. 3(*b*1), the pressure of the hydraulic fluid 8 was increased to 150 atm with advancing the sealing-punch 6 and 7. Thus, primary hydroforming was performed to thereby form the expanded portion 3*a*' having a circular cross-section which has a circumferential length of 350 mm.

A maximum axial force was 32 tons. Next, while the fluid pressure was held at 150 atm, the pressure units 52 were activated so as to press the primary expanded portion 3*a*' in a vertical direction with the upper and lower pads 43 and 44. Thus, secondary hydroforming was performed to thereby obtain the expanded portion 3*a* having a rectangular cross section measuring a height $D_1$ of 50 mm and a width $D_2$ of 150 mm as shown in FIG. 3(*d*), yielding the product 3. The corner radius R of a cross section of the expanded portion 3*a* was 14 mm as required. A minimum wall thickness was 1.8 mm, which satisfied a required wall thickness of 1.6 mm for the product 3.

Figure 13:
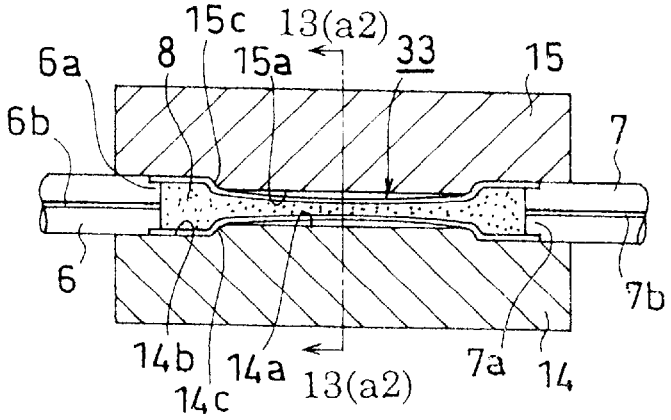
FIG. 13(*a*1) is a longitudinal sectional view showing a flattened metallic tube to be hydroformed.
Figure 13:
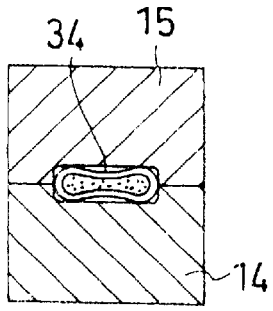
Figure 13:
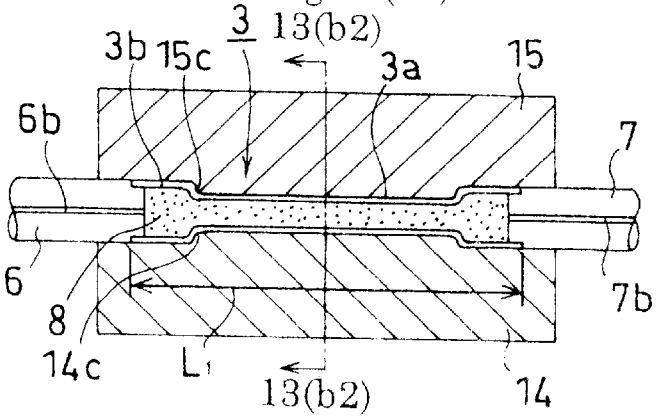
Figure 13:
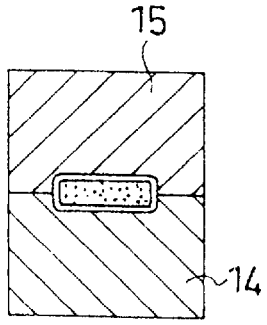

Next, a metallic tube similar to the above metallic tube 1 was hydroformed according to a conventional hydroforming method. As shown in FIG. 12(*a*1), the plugs 32*b* having an outer diameter of 84.5 were inserted into corresponding tube ends. The thus-arranged metallic tube was flattened as shown in FIG. 12(*b*1), obtaining D1'=48 mm and D2'=110 mm (FIG. 12(*b*2)). Subsequently, as shown in FIG. 13(*a*1), the thus-flattened metallic tube was set in the lower die 14. The upper die 15 was pressed against the lower die 14 with a die clamping force of 500 tons. The sealing punches 6 and 7 were sealed against corresponding tube ends. The metallic tube was filled with the hydraulic fluid 8, which was an emulsion prepared by dispersing a fat-and-oil component in water in an amount of 3%.

Next, as shown in FIG. 13(*b*1), while the sealing punches 6 and 7 were held stationary, fluid pressure was increased to 700 atm, yielding the product 3 having the expanded portion 3*a*. The corner radius R of a cross section of the expanded portion 3*a* was 14 mm. A wall thickness of the expanded portion 3*a* was 1.6 mm, which was a required wall thickness for the product 3.

Figure 14A:
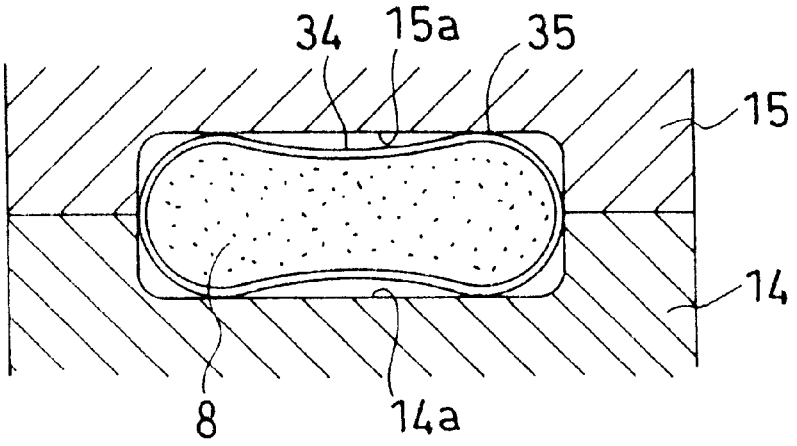
FIG. 14(*a*) is a sectional view showing an initial stage of hydroforming, illustrating generation of a concave shaped defect.
Figure 14B:
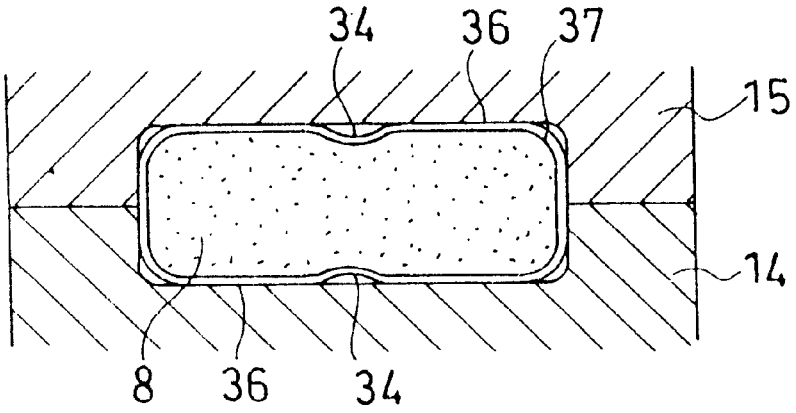
Figure 14C:
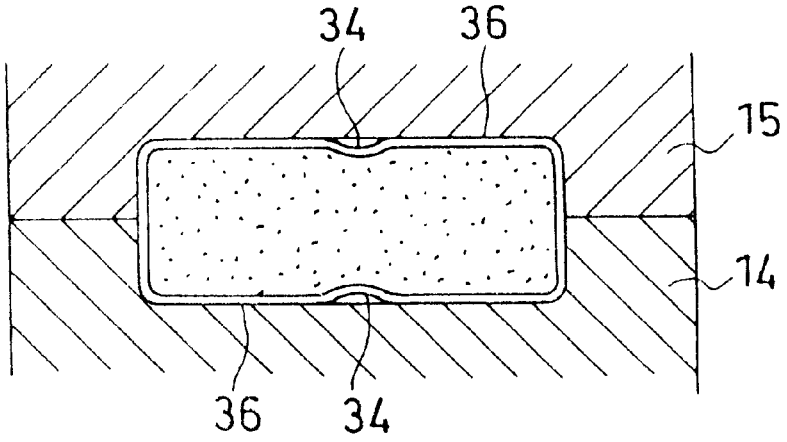

However, the concave 34 (FIG. 14(*c*)) having a depth of 2 mm and a width of 8 mm remained in a flat surface of the expanded portion 3*a*. Thus, the product 3 free of the shape defect could not be obtained.

As described above, the hydroforming method of the present invention is smaller in die clamping force and fluid pressure than the conventional hydroforming method. Further, the obtained product 3 is such that the degree of wall thinning of its expanded portion is relatively small and a concave or like shape defects are not formed.

According to a hydroforming method and a hydroforming apparatus of the present invention, wall thinning at corner portions of a cross section of an expanded portion can be suppressed. Thus, the present invention allows the wall thickness of a metallic tube to be minimized and is applicable to the hydroforming of a tube material having a relatively poor ductility.

Also, according to the present invention, a metallic tube does not need to be flattened so as to be received in a die. Thus, no concave defect remains in a hydroformed product. Further, the pressure of a hydraulic fluid for hydroforming can be made relatively low, a die clamping force imposed by a ram head and an axial force can be reduced. These features lead to a reduction in hydroforming equipment cost. Since reduced fluid pressure allows the strength of a hydroforming die to be reduced, die cost can be reduced. Thus, the present invention yields a significant effect of reducing tube hydroforming cost.

What is claimed is:

1. A method for hydroforming a metallic tube in order to form an expanded portion having an arbitrary cross-sectional profile through application of a fluid pressure into the interior of the metallic tube contained in a pair of upper and lower dies, said method comprising the steps of primary hydroforming and secondary hydroforming, wherein in the primary hydroforming step, the metallic tube is formed such that a circumferential length of an expanded portion of the primary-hydroformed tube becomes substantially equal to or slightly shorter than the circumferential length of an expanded portion of a product, and in the secondary hydroforming step, the expanded portion formed through primary hydroforming is pressed by one movable pad at least incorporated within the dies so as to form the cross-sectional profile of the expanded portion into that of the expanded portion of the product, and said primary hydroforming and secondary hydroforming are continuously performed within the dies.

* * * * *